US007062873B2

(12) United States Patent
Hlavin

(10) Patent No.: US 7,062,873 B2
(45) Date of Patent: Jun. 20, 2006

(54) GOLF MARKING FLAG FOR ATTACHMENT TO MOVEABLE POLES FOR MARKING HOLE LOCATION IN GOLF COURSE GREENS

(75) Inventor: Dale J. Hlavin, Westlake, OH (US)

(73) Assignee: Markers, Inc., Avon Lake, OH (US)

( * ) Notice: Subject to any disclaimer, the term of this patent is extended or adjusted under 35 U.S.C. 154(b) by 7 days.

(21) Appl. No.: 10/674,708

(22) Filed: Sep. 30, 2003

(65) Prior Publication Data

US 2005/0066561 A1 Mar. 31, 2005

(51) Int. Cl.
*G09F 15/02* (2006.01)

(52) U.S. Cl. ..... 40/607.1; 40/218; 40/607.03; 116/174

(58) Field of Classification Search ..... 40/607.1, 40/607.01, 607.03, 218, 412, 413, 422, 440; 116/173, 174

See application file for complete search history.

(56) References Cited

U.S. PATENT DOCUMENTS 4,024,833 A * 5/1977 Pook et al. ..... 116/173
5,253,608 A * 10/1993 Burke ..... 116/173
5,572,835 A * 11/1996 Atkins et al. ..... 52/111
5,603,389 A * 2/1997 Zemon ..... 182/133
5,943,980 A * 8/1999 Huang ..... 116/174
5,975,009 A * 11/1999 Nihra et al. ..... 116/173
6,495,238 B1 * 12/2002 Campbell ..... 428/121
6,748,683 B1 * 6/2004 Schultz ..... 40/218

* cited by examiner

*Primary Examiner*—Joanne Silbermann
(74) *Attorney, Agent, or Firm*—Hudak, Shunk & Farine Co. LPA

(57) ABSTRACT

A golf marking flag for attachment to a supporting upright pole having flag attachment means comprising a linear sleeve adapted to loosely slip over the upright pole to enable unobstructed rotation of the flag in response to wind direction along with a flexible tab secured to the top of the linear sleeve and adapted to rotatably engage an upwardly extending narrow pin located at the top of the upright pole. The flexible tab contains an opening larger than the narrowed upright extension to enable free rotation of the tab around the narrowed extension, while the opening is smaller than the upright pole to enable the larger pole to vertically support the marking flag. The flexible tab supports the marking flag on the upright pole while the sleeve enables rotation of the marking flag about the upright pole. The golf marking flag can be attached directly to an upright pole or adapted to be interconnected to an intervening swivel harness to provide indirect connection to the upright pole. A golf marking flag with direct and indirect connections to the upright pole provides a universal golf marking flag attachable to all types of upright poles and avoids manufacturing and stocking multiple marking flags dependant upon the style of intervening swivel connectors for interconnecting flags to poles.

5 Claims, 2 Drawing Sheets

GOLF MARKING FLAG FOR ATTACHMENT TO MOVEABLE POLES FOR MARKING HOLE LOCATION IN GOLF COURSE GREENS

BACKGROUND OF THE INVENTION

This invention pertains to marking flags on movable poles for marking points in golf courses, and more particularly to marking flags with improved attachments means to marking poles for identifying hole placement in the golf course greens.

Golf courses are require to use marking flags attached to movable upright poles to identify hole location in the greens. Most golf courses change the location of the hole in the green from day to day to rearrange the competitive location of the hole as well as to distribute the grass wear evenly over a season. Golf courses frequently utilize a color flag marking system to indicate depth of pin placement on the green. For instance, a red flag can be used for front pin placement, a white flag for middle placement, and a yellow flag for back placement. Marking poles used for marking pin placement are customarily removed from each hole upon a group of golfers reaching each green and putting. The marking flags have a rotatable connection with the upright poles to enable the marking flags to rotate freely with the wind to indicate wind direction to a distant golfer.

Current golf marking flags can be connected to an upright pole by attachment to a rotatable harness or swivel connector interconnecting the flag with the pole. The swivel connector ordinarily is a rigid wire connector having two or three rings rotatably mounted on the pole. By convention, a golf marking flag ordinarily is 14" by 18" or 20" in size, where the 14" dimension is the vertical attachment side adapted for interconnection to the upright pole. The longer dimension is the lateral top and bottom of the flag. Typically a flag may have three vertically spaced grommets or other openings in the attachment side of the flag for interconnection with the swivel connector. The flag can be tied off, clipped, hooked or otherwise attached to a three similarly spaced connectors on the swivel connector. The swivel connector ordinarily has two or three vertically spaced rings for rotatable attachment to the upright pole to enable rotation of the flag in response to wind direction. The one or two lower rings are sufficiently larger than the pole diameter to enable the rings to easily slip over the pole and provide operative free rotation of the flag about the pole. The uppermost ring on the swivel connector is a smaller diameter ring adapted to loosely fit over and rotate freely around an upwardly extending reduced diameter pin or threaded screw. The juncture of the smaller diameter upright extension with the larger diameter pole forms a laterally disposed radially orientated peripheral shoulder. The peripheral shoulder enables the upper small diameter ring to rotatably engage the upright extension while riding on the larger diameter shoulder. The peripheral shoulder provides vertical support to the swivel connector and in turn prevents the marking flag from falling off of the upright pole. A capping fitting or nut can then be tightened onto the upright pin or screw to prevent dislodgement of the upper small diameter ring from the pole. The capping fitting or nut merely caps the pin or screw but is maintained vertically spaced from the upper small diameter ring to enable free rotation of the small diameter ring below the capping fitting or nut. The swivel connectors are somewhat standardized to provide aligned attachment to similar three vertically spaced openings provided in the heavy hemming on the attachment side of each flag. Most golf marking flags are changed frequently to indicate front, center, or back placement of the pin in each green. Marking flags are cloth or canvas and need to be changed from time to time due to weathering deterioration. Sometimes flags are changed to provide logos on alternative marking flags for golf tournaments sponsored by specific sponsors.

Other swivel connectors consist of a plastic extruded hollow tube permanently secured to a marking flag. The plastic tube typically is glued, stapled or otherwise secured to the marking flag where the attaching edge of the marking flag can be tightly wrapped around and glued to the plastic tube. Most golf marking flags utilize a cylindrical tubular plastic extrusion with a radially outwardly extending elongated fin to facilitate gluing, stapling, sewing, or otherwise permanently securing the extruded tube within a folded attaching side of the marking flag. The top of the plastic tube is fitted with a plug or cap having narrow diameter central hole to enable rotation about the upwardly extending pin or screw. The plug or fitting itself rides on the laterally extending peripheral shoulder as previously described and facilitates rotation of the marking flag about the pole. Permanently securing the flag to the plastic tube prevents the marking flag from sliding down the upright pole independently of the tubular insert. A pinching cap or capping nut can cap the upright extension to prevent dislodgment of the plastic tube and marking flag from the pole while the flag is free to rotate 360 degrees.

The above described prior art swivel connectors and attaching flags require separate parts to produce entirely different style marking flags, which are time consuming and costly to assemble. Each flag configuration requires its own separate style swivel connector and separate parts. Neither the flags nor the connectors are interchangeable. Replacement flags must be designed for use with the specific swivel connection mechanism currently being used by the particular golf course. An old plastic insert marking flag assembly for instance must be completely discarded and a new plastic insert flag assembly must be acquired to change plastic tube marking flags. The rigid wire swivel connectors require a separate swivel connecting means to connect the marking flag to the pole, where the replacement flags must contain grommets for connection to the wire swivel connectors. Neither flag nor respective swivel connectors are interchangeable. Consequently, golf marking flag manufacturers must produce and supply a variety of swivel connecting parts which in turn must be assembled with a different swivel connecting means for attachment to the golf marking poles being used by a golf course.

BRIEF SUMMARY OF THE INVENTION

It now has been found that an improved self supporting golf marking flag adapted to be rotational on an upright pole eliminates the need for an intervening swivel connector. The self supporting flag of this invention comprises a linear side attachment sleeve adapted to slip freely over an upright marking pole. A flexible tab secured to the top part of the sleeve contains an opening adapted to rotatably engage the top of the upright pole and maintain vertical support for the marking flag, whereby the flag is free to rotate about the pole in response to wind direction. The flexible tab opening is adapted to rotatably fit over an upwardly extending narrow diameter pin or threaded screw extension secured to the top of the larger diameter upright pole. The sleeve maintains engagement with the pole and enables 360 degree flag rotation, while the flexible tab vertically supports the flag and permits unobstructed rotation of the marking flag. The marking flag of this invention provides a self supporting flag without need for an additional swivel connector or other rotatable interconnecting means for attaching the marking flag to the upright pole. A removable plastic tube can be inserted in the sleeve to facilitate rotation on the pole if desired. The sleeve and flexible tab combination enables expedient attachment and removal of the marking flag to the pole. The marking flag of this invention can be utilized as a universal marking flag adapted primarily for self supporting attachment directly to an upright pole, but can be adapted to provide a universal marking flag for attachment to existing swivel connectors if desired. A universal marking flag provides one flag design to fit all upright marking poles and eliminates the need for producing a variety of separate marking flags to fit a variety of non-interchangeable swivel connectors. These and other advantages of this invention will be more apparent by referring to the drawings and the detailed description of the invention.

DETAILED DESCRIPTION OF THE INVENTION

Figure 1:
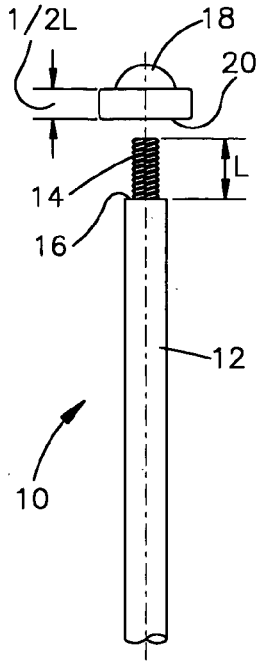
Fig.1 (PRIOR ART)
FIG. 1 is a partial front elevation view of a typical upright pole for supporting a golf marking flag used for identifying hole location in golf course greens.
Figure 2:
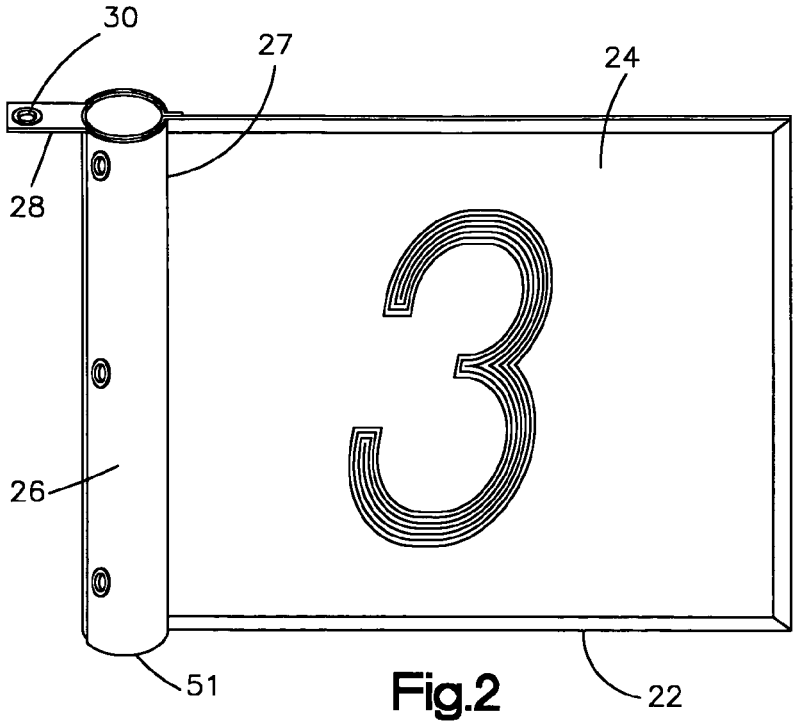
FIG. 2 is front perspective view of the golf marking flag of this invention for attachment to the upright pole shown in FIG. 1.
Figure 3:
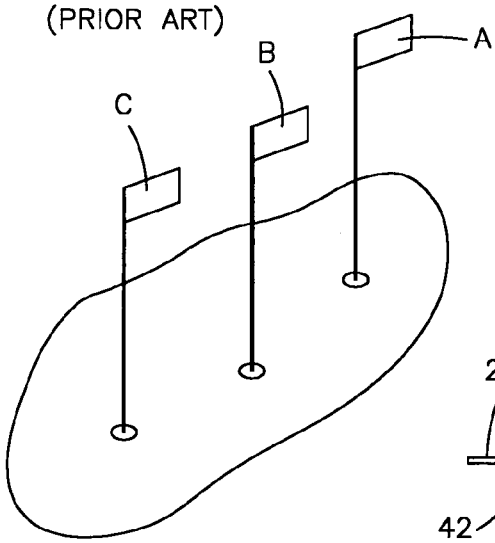
Fig.3 (PRIOR ART)
FIG. 3 is an illustration of a golf course green showing alternative hole location and pin placement on the same golf course green.

Referring now to the drawings wherein like reference numbers designate like parts, shown in FIG. 1 is the upper part of a conventional marking pin 10 for marking location of a golf hole in a golf course green. The location of a hole in a particular green frequently changes where a golf marking pin 10 may be positioned in location "A" or "B" or "C", as illustrated in FIG. 3, where "A" can be a red flag indicating pin placement in the front part of the green, "B" can be a white flag indicating pin placement in the middle of the green, and "C" can be a yellow flag indicating pin placement in the back part of the green. The golf marking pin 10 comprises an upright pole 12 terminated at the top end with an upwardly extending smaller diameter pin or threaded screw 14 of vertical length "L". The juncture of the larger diameter pole and the reduced diameter threaded pin or screw 14 forms an intervening laterally disposed peripheral shoulder 16. The upright threaded screw 14 is adapted to engage a threaded capping nut 18 having internal threads with a threaded depth of about "½ L" to leave vertical spacing of about "½ L" between the lower edge 20 of the capping nut 18 and the peripheral shoulder 16 when the capping nut 18 is tightened downwardly onto the upright screw 14. The lengths "L" and "½ L" are not critical, but merely illustrative to suggest useful relative dimensions that provide vertical spacing between the capping nut lower edge 20 and the peripheral shoulder 16 when the capping nut 18 is tightened on the upright screw 14.

The golf marking flag 22 of this invention comprises a field 24 normally displaying the number of the golf hole, a vertical hemmed sleeve 26 on the left side of the field 24, and an extending flexible tab member 28 secured to the top of the sleeve and containing an interior opening or grommet 30. The vertical sleeve 26 can be formed by sewing or otherwise securing the sleeve 26 at the seam 27 intervening between the sleeve 26 and the flag field 24. The sleeve 26 diameter is considerably larger than the diameter of the upright pole 12 to enable the marking flag 22 to freely slip over the top end of the upright pole 12 and provide unobstructed rotation of the marking flag 22 about the upright pole 12. The flexible tab 28 containing the grommet 30 or other opening is adapted to slip over the upwardly extending screw 14 to ride on and be supported by the peripheral shoulder 16 of the pole 12. The inner diameter of the grommet opening 30 is larger than the outside diameter of the upright threaded screw 14 to facilitate placing the grommet 30 over the screw 14 and maintain free rotation of the oversize grommet opening 30 around the upright screw 14. The grommet opening 30 is somewhat smaller than the outer diameter of the peripheral shoulder 16 to enable the tab member 28 to rotate around the upright screw 14 while riding on the peripheral shoulder 16. The tab 28 vertically supports the flag 22 and permits 360 degree rotation of the grommet 30 and flag 22 about the axis of the upright pole 12. The capping nut 18 can be secured to the top part of the screw 14 to prevent the tab 28 from dislodging from the top of the pole 12 while maintaining rotational movement of the marking flag 22. Typically "½ L" is maintained between the bottom 20 of the capping nut 18 and the shoulder 16 to permit unobstructed rotation of the tab grommet 30 around the upright screw.

Figure 5:
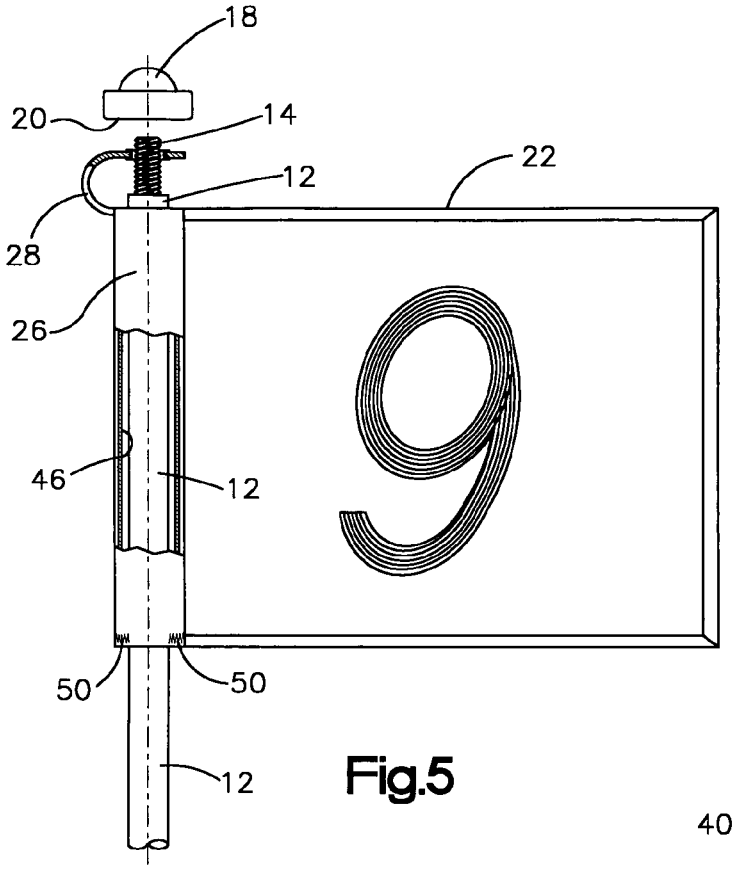
FIG. 5 is a front elevation view of the golf marking flag in FIG. 1 containing a tubular insert shown in partial section and assembled on the golf marking pole in FIG. 1.

In a desirable aspect of attaching the marking flag 31 to the upright pole 12, a cylindrical removable plastic hollow tube 46 can be inserted into the sleeve 26 to facilitate rotation of the flag 22 as well as minimize wear and tear of the flag material against the upright pole 12. The tube 46 provides extra support for the flag 22 and can be removed and reused in a replacement flag. The plastic tube 46 inserted within the sleeve 26, as viewed in FIG. 5, is maintained and supported within the sleeve 26 by a narrowed bottom opening 48 having a diameter smaller than the external diameter of the plastic tube 46. The bottom end 51 of the sleeve 26 is partially closed by stitching to form a pinched bottom seam 50 defining the small bottom opening 48 adapted to receive the pole 12. The narrowed opening 48 typically can be formed by partially sewing, gluing, crimping or otherwise partially securing the laterally disposed bottom 51 of the sleeve 26. The surrounding larger diameter plastic tube 46 is vertically supported within the sleeve 26 by the pinched seam 50. The plastic tube insert 46 can be slipped into and retained within the sleeve 26 by the pinched bottom seam 50, while the entire flag 31 can be vertically supported by bending the tab 28 to rotatably engage the upright screw 14, as shown in FIG. 5. The flag 31 fitted with a plastic tube is supported vertically by engaging the flag tab 28 with the threaded screw 14 in accordance with this invention. An alternative but less preferred mode of vertically supporting the removable plastic tube 46 can be achieved by a narrowed diameter tube adapter secured to the top of the plastic tube 46, where the narrowed adaptor slip fits over the upright screw 14 and rests on the enlarged peripheral shoulder 16. Vertical support of the flag 22 is maintained by the tab 28 rotatably engaging the upright screw 14.

Figure 4:
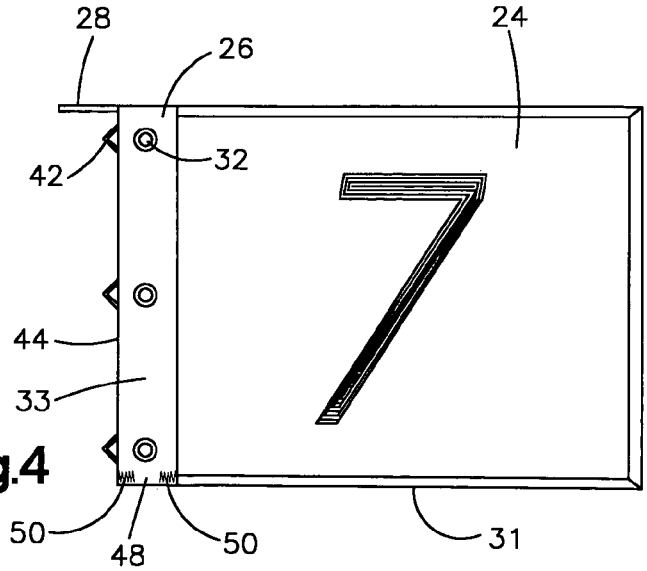
FIG. 4 is a front elevation view of the golf marking flag shown in FIG. 2 containing universal attachment means adapted for attachment to conventional swivel connectors rotatably attached to upright golf marking poles.
Figure 6:
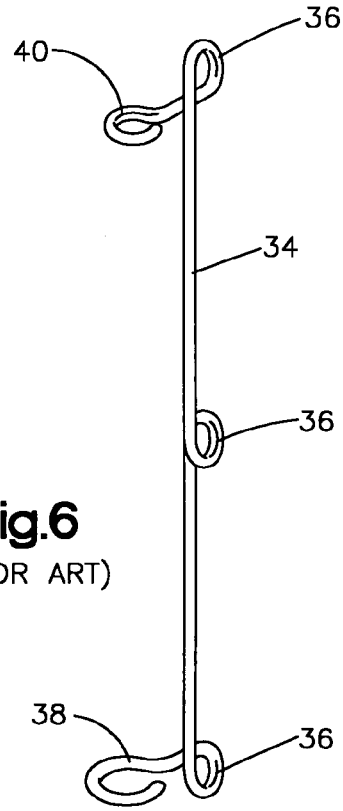
Fig.6 (PRIOR ART)
FIG. 6 is a conventional swivel connector for attaching a conventional golf marking flag to the marking pole in FIG. 1.

FIG. 4 illustrates the golf marking flag 22 of this invention adapted to provide a universal marking flag 31 capable of direct attachment to an upright pole 12 as described above, or capable of indirect attachment to an intervening attachment means conventionally used on golf course marking pins 10, such as a swivel connector 34 harness shown in FIG. 6. The sleeve 26 of flag 31 comprises a front flap 33 shown in the drawings and a comparable rear flap (not shown) to form the sleeve member 26. The front and rear flaps 33 of sleeve 26 contain attachment means for connection to existing connectors 36 on the rigid wire swivel connector 34. The attachment means on the universal flag 31 comprises a plurality of openings in the front flap 33 aligned with a second set of openings in the back flap of the sleeve 26 to provide the attachment means to the rigid wire swivel connector 34. The openings in the respective front flap 33 and back flap are vertically spaced and aligned to enable each pair of aligned openings to be attached to similarly spaced connectors 36 on the swivel connector 34. The openings are shown as grommets 32 but can be button holes, eyelets, slits or similar openings. The swivel connector 34 includes two or three vertically spaced connecting rings consisting of one or two larger diameter lower slip rings 38 adapted to freely slip over and rotate freely about a lesser diameter marking pole 12. The swivel connector 34 further contains a small diameter uppermost supporting ring 40 having a diameter smaller than the diameter of the upright pole 12, but larger than the narrowed upwardly extending screw 14. The small ring 40 is adapted to fit over the narrower upright screw 14 and be operatively supported by the peripheral shoulder 16 to enable rotation of the marking flag 10 without the flag 10 falling from the upright pole 12. In a similar manner, alternative attachment means for attaching the universal flag 31 to the swivel rigid connector 34 can comprise a plurality of attachment means shown as three vertically spaced angular loop connectors 42 secured to the external edge 44 forming the spline of the front and back flaps 33 of the sleeve 26. The angular loops 42 can be arcuate or other configuration secured to the sleeve edge 44 and adapted to be attached to similarly spaced connectors 36 on the swivel connector 34. The connectors 36 on the swivel connector 34 can be attached to universal flag 31 by any suitable interconnecting attachment means such as a clip or a simple ring. The flexible extension flap 28 can be rotatably engaged with the upright screw 14 by laterally outward extension of the flap 28 as seen in FIG. 4. The universal marking flag 31 provides multiple attachment capability from one flag product and avoids stocking multiple flag products dependant upon the type of flag and/or type of connector means utilized by a particular golf course.

Although preferred aspects of the invention have been described and illustrated in the drawings, the invention is not intended to be limited thereby, except by the appended claims While in accordance with the patent statutes, the best mode and preferred embodiment have bee set forth, the scope of the invention is not limited thereto, but rather by the scope of the attached claims.

What is claimed is:

1. A self-supporting golf marking flag for direct attachment to an upright movable pole for marking holes on golf course greens, the upright pole having an upwardly extending pin member having a reduced thickness smaller than the thickness of the upright pole forming a peripheral shoulder at the juncture of the extended pin and the upper end of the upright pole, the flag adapted to be self-supporting whole rotatably supported on the upright pole, the golf marking flag comprising:

a flag with an attachment side for direct rotatable attachment to the upright pole, the attachment side having a hemmed linear sleeve adapted to loosely slip over the upright pole, the hemmed sleeve having an upper flexible extension tab with an opening adapted to loosely engage the narrowed extension pin on top of the upright pole, the flexible extension tab rotatably supported by the peripheral shoulder of the upper upright pole, while the linear sleeve is rotatably attached to the upright pole;

the golf marking flag rotatably attached to the upright pole by slipping the flag sleeve over the upright pole, the flexible tab loosely rotatably engaging the extending pin for vertically supporting the flag on the upright pole while the sleeve loosely rotatably engages the upright pole;

where the upright pole and upwardly extending pin are circular, where the tab opening is larger than the diameter of the extending pin but smaller than the diameter of the upright pole to provide rotatable support of the marking flag on the upright pole, and a capping member secured to the top of the upwardly extending pin spaced upwardly from the peripheral shoulder of the upright pole to prevent dislodgment of the flexible tab from the extension pin while permitting loose rotation of the flexible tab about the extension pin;

where the flag sleeve contains a removable tubular insert with an diameter larger than the upright pole diameter to facilitate rotation of the marking flag about the upright pole; and where the bottom end of the linear sleeve is partially closed to provide a narrowed opening in the bottom end of the sleeve, the tubular insert having an outside diameter larger than the narrowed opening in the sleeve to prevent the tubular insert from falling our of the linear sleeve.

2. A golf marking flag for attached to an upright pole to provide a movable flag identifier on golf courses, the upright pole having an upwardly extending pin member attached to the upper end of the upright pole, the upwardly extending pin having a reduced thickness smaller than the thickness of the upright pole forming a peripheral lateral shoulder at the juncture of the upwardly extending pin and the upper terminal end of the upright pole, the marking flag adapted to rotate on the upright pole in response to wind movements, the marking flag comprising:

a self-supporting flag having an attachment side with a linear hemmed sleeve adapted to loosely slip over the upright pole and enable free rotation of the flag about the upright pole, the linear sleeve having an upper flexible extension tab secured to the uppermost part of the linear sleeve, the tab having an opening large enough to rotatably engage the upwardly extending pin but smaller than the thickness of the upright pole to enable the extension tab to rest upon and be rotatably supported on the peripheral lateral shoulder between the upright pin and the terminal end of the upright pole, where the extension tab vertically supports the marking flag on the upright poke while permitting rotational movement of the flag about the upright pole;

where the upright pole and upwardly extending pin are circular, where the tab opening is larger than the diameter of the extending pin but smaller than the diameter of the upright pole to provide rotable support of the marking flag on the upright pole, and a vertical spaced capping member secured to the top of the upwardly extending pin to prevent dislodgment of the flexible tab from the extension pin while permitting loose rotation of the flexible tab rotatably engages the extending pin while maintaining vertical support of the flag on the upright pole.

3. The golf marking flag of claim 2 where the opening in the tab is a metal grommet.

4. The golf marking flag of claim 2 where the flag sleeve contains a removable tubular insert with an inside diameter larger than the upright pole diameter to facilitate rotation of the marking flag about the upright pole.

5. The golf marking flag of claim 2 where the tubular insert is a plastic tube.

* * * * *